US012516674B1

(12) United States Patent
Tiitinen et al.

(10) Patent No.: US 12,516,674 B1
(45) Date of Patent: Jan. 6, 2026

(54) MULTI-STAGE CENTRIFUGAL PUMP COMPRISING AN ASSEMBLY FOR COMPENSATING AXIAL FORCES

(71) Applicant: Sulzer Management AG, Winterthur (CH)

(72) Inventors: Kalle Tiitinen, Tampere (FI); Matti Koivikko, Kotka (FI); Jouni Vartiainen, Kotka (FI)

(73) Assignee: Sulzer Management AG, Winterthur (CH)

( * ) Notice: Subject to any disclaimer, the term of this patent is extended or adjusted under 35 U.S.C. 154(b) by 0 days.

(21) Appl. No.: 18/836,662

(22) PCT Filed: Feb. 24, 2023

(86) PCT No.: PCT/EP2023/054634

§ 371 (c)(1),
(2) Date: Aug. 7, 2024

(87) PCT Pub. No.: WO2023/161391

PCT Pub. Date: Aug. 31, 2023

(30) Foreign Application Priority Data

Feb. 25, 2022 (EP) ..... 22158834

(51) Int. Cl.
*F04D 29/041* (2006.01)
*F04D 1/06* (2006.01)
*F04D 29/047* (2006.01)

(52) U.S. Cl.
CPC ..... *F04D 29/0416* (2013.01); *F04D 1/06* (2013.01); *F04D 29/0473* (2013.01)

(58) Field of Classification Search
CPC ..... F04D 1/06; F04D 29/041; F04D 29/0413; F04D 29/0416; F04D 29/0473; F04D 29/051; F04D 29/0513; F04D 29/0516
See application file for complete search history.

(56) References Cited

U.S. PATENT DOCUMENTS 5,215,448 A * 6/1993 Cooper ..... F04D 5/001 417/423.5
2024/0175447 A1* 5/2024 Vartiainen ..... F04D 29/12

FOREIGN PATENT DOCUMENTS

DE 681087 C * 9/1939

* cited by examiner

*Primary Examiner* — Christopher R Legendre
(74) *Attorney, Agent, or Firm* — Global IP Counselors, LLP

(57) ABSTRACT

A multi-stage centrifugal liquid pump includes a housing, impellers, and an assembly to compensate axial forces in the multi-stage centrifugal liquid pump. The assembly includes a shaft arranged rotatably to the housing, a balancing drum arranged to the shaft inside the housing, the balancing drum having a first axial end surface and a second axial end surface, the first axial end surface in flow communication with a stage of the pump adjacent to the balancing drum, the balancing drum being a multistage balancing drum, including at least two drum sections, and a circumferential axial space arranged between the at least two drum sections, the drum sections having a first radius.

19 Claims, 5 Drawing Sheets

A

B

MULTI-STAGE CENTRIFUGAL PUMP COMPRISING AN ASSEMBLY FOR COMPENSATING AXIAL FORCES

CROSS-REFERENCE TO RELATED APPLICATION

This application is a U.S. National Stage application of International Application No. PCT/EP2023/054634, filed Feb. 24, 2023, which claims priority to European Application No. 22158834.6, filed Feb. 25, 2022, the contents of which are hereby incorporated by reference in their entirety.

BACKGROUND INFORMATION

Technical Field

The present disclosure relates to a multi-stage centrifugal pump comprising an assembly for compensating axial forces in a multi-stage centrifugal liquid pump.

Background Art

Conventional centrifugal multi-phase centrifugal liquid pumps can include impeller wheels arranged into a housing by a rotatably supported shaft. During the operation of such centrifugal flow machines axial forces are subjected to the shaft. Such axial forces can be minimized by suitably designing the pump. Remaining forces are transmitted to the housing via a thrust bearing. Balancing axial forces is particularly relevant to multi-stage centrifugal flow machine where each stage results in an axial force component i.e., thrust to the system. The net axial thrust of an impeller is the difference between forces acting on back and front shrouds. There are number of hydrodynamic effects that can alter these forces. For instance, ring leakage or impeller axial positioning relative to the volute or diffuser can alter the pressure distribution between the impeller and sidewall gaps. Relatively small changes in pressure are greatly magnified by the large projected shroud surface areas. The result can be very large shifts in axial thrust in either direction.

SUMMARY

It is known as such to use a so-called balancing drum of minimizing the axial forces subjected to the bearings. A balancing drum is a part connected to a drive shaft of the machine, which drum has a cylindrical outer surface parallel with a center axis of the shaft of the centrifugal flow machine. The housing of the centrifugal flow machine includes a cylindrical space for the balancing drum. There is a clearance gap arranged between the balancing drum and the space in the housing. The purpose of the gap is to provide a flow restriction providing a pressure difference over the balancing drum. However, it has been discovered that the clearance gap makes it possible for the process liquid to flow through the gap to some extent and therefore the efficiency of the centrifugal flow machine is decreased. Thus, it has been discovered that that use of a balancing drum does not totally eliminate the need of a thrust bearing.

The balancing drum provides an axial force which is based on hydraulic properties of the pump, dimensional proportions and prevailing operating point of the pump. Production tolerances, number impeller wheels and actual shape of pumps components cause deviation from designed compensating force of the balance drum. Thus, actual residual axial force may be considerably greater than the dimensioned one, which effects on dimensioning, lifetime and/or service interval of bearings.

Publication JP 01-237394 (JP '394) discloses a balance piston provided in a centrifugal gas compressor. JP '394 discloses a sealing ring attached to the inner peripheral surface of the casing is divided into three pieces in the axial direction and are arranged apart from each other. A high-pressure side sealing ring provided near the high-pressure gas chamber is opposed to a large-diameter portion of the balance drum. A low-pressure side sealing ring provided near the low-pressure gas chamber faces also the large-diameter portion of the balance drum. There is a middle sealing ring provided in the center portion which is opposed to the middle diameter portion of the balance drum. In this way, the annular space interposed between the sealing rings at both ends is partitioned into the low-pressure auxiliary chamber and the high-pressure auxiliary chamber by the middle sealing ring. A communication passage is provided to guide the high pressure of the high-pressure chamber to the high-pressure auxiliary chamber and keep the internal pressure of the high-pressure auxiliary chamber at high pressure. There is also disclosed a communication path which is provided to guide the low pressure of the low-pressure chamber to the low-pressure auxiliary chamber and keep the internal pressure of the low-pressure auxiliary chamber at the low pressure. JP '394 provides a balance piston for a gas compressor where distinct sealing rings separate the auxiliary chambers.

An object of the disclosure is to provide an assembly for compensating axial forces in a multi-stage centrifugal liquid pump which performance is considerably improved compared to the prior art pumps.

An object of the disclosure is to provide a multi-stage centrifugal liquid pump in which axial forces are compensated by such an assembly.

Objects of the disclosure can be met substantially as is disclosed herein, including a description of more details of different embodiments of the disclosure.

According to the disclosure a multi-stage centrifugal liquid pump comprising an assembly for compensating axial forces in the multi-stage centrifugal liquid pump, comprises

- a housing,
- a shaft arranged rotatably to the housing, to which shaft the impellers of the pump are coupled,
- a balancing drum arranged to the shaft inside the housing,
- the balancing drum having a first axial end surface and a second axial end surface, wherein the first axial end surface is in flow communication with a stage of the pump adjacent to the balancing drum.
- the balancing drum is a multistage balancing drum, which comprises at least two drum sections and there is a circumferential axial space arranged between the drum sections, the drum sections having a first radius, wherein
  - the circumferential axial space has a first axial length and a bottom, which bottom has a second radius, which is smaller than the first radius
- the assembly comprises in the housing at least one ring element at axial position of the circumferential axial space, extending radially into the axial space to proximity of the bottom of the axial space, wherein
  - the at least one ring element has a radial inner surface having a third radius, greater than the second radius,
  - the at least one ring element has a second axial length, which is less than the first axial length the assembly comprises a first pressure chamber between a first side wall of the circumferential axial space and a first side wall of the ring element, the assembly comprises a second pressure chamber between a second side wall of the circumferential axial space and a second side wall of the ring element, wherein the first pressure chamber is nearer to the pump than the second pressure chamber, and the assembly comprises a first flow communication path extending from the stage of the pump nearest to the balancing drum, to the second pressure chamber, the assembly comprises a second flow communication path extending from the stage of the pump farthest from the balancing drum to the first pressure chamber, the assembly comprises first annular flow path between the first pressure chamber and the second pressure chamber via the bottom of the circumferential axial space and inner surface of the ring element, and the assembly comprises second annular flow path extending out from the first pressure chamber and from the second pressure chamber via the outer surface of the drum sections and the inner surface of the housing.

By the present disclosure axial forces caused by a multi-stage centrifugal liquid pump are compensated efficiently. There are several, or at least two, axially successive balancing drum sections which each create an equal counter force for the axial force created by the pump. The assembly makes it possible to reduce the size of the balancing drum, and the diameter of the shaft, while the power consumption, power loss, is minimized as compared to a single stage balancing drum.

The stage of the pump nearest to the balancing drum can be either inlet of the pump or outlet of the pump, depending on the actual practical design. The preferable embodiment is to arrange the outlet of the pump adjacent to the balancing drum.

According to an embodiment of the disclosure a multi-stage centrifugal liquid pump comprising an assembly for compensating axial forces in a multi-stage centrifugal liquid pump having an inlet and an outlet being arranged so that the outlet is adjacent to the assembly for compensating axial forces, the assembly comprises a housing, a shaft arranged rotatably to the housing, to which shaft the impellers of the pump are coupled.

a balancing drum arranged to the shaft inside the housing, the balancing drum having a first axial end surface and a second axial end surface, wherein the first axial end surface is in flow communication with the outlet of the pump, the balancing drum is a multistage balancing drum, which comprises at least two drum sections, wherein there is a circumferential axial space arranged between the two drum sections, the drum sections having a first radius R1, the circumferential axial space has a first axial length and a bottom, which bottom has a second radius R2, which is smaller than the first radius, the assembly comprises in the housing, at least one ring element at axial position of the axial space, extending radially into the axial space to proximity of the bottom of the axial space, wherein the at least one ring element has a radial inner surface having a third radius, greater than the second radius, the at least one ring element has a second axial length, which is less than the first axial length the assembly comprises a first pressure chamber between a first side wall of the circumferential axial space and a first side wall of the ring element, the assembly comprises a second pressure chamber between a second side wall of the circumferential axial space and a second side wall of the ring element, wherein the first pressure chamber is closer to the pump than the second pressure chamber, and the assembly comprises a first flow communication path extending from outlet of the pump to the second pressure chamber, the assembly comprises a second liquid communication path extending from inlet of the pump to the first pressure chamber, the assembly comprises first annular flow path between the first pressure chamber and the second pressure chamber via the bottom of the circumferential axial space and inner surface of the ring element, and second annular flow path extending out from the first pressure chamber and from the second pressure chamber via the outer surface of the drum section and the inner surface of the housing.

A balancing drum and its sections are parts connected to the shaft of the pump, which drum or the drum sections have cylindrical outer surface parallel with a center axis of the shaft. The housing includes a cylindrical space for the balancing drum. There is an annular clearance gap arranged between radially outer surface the balancing drum sections and radially inner wall of the housing. The purpose of the clearance gap is to provide an axial flow restriction providing a pressure difference over the balancing drum. The pressure difference over the balancing drum sections provides an axial balancing force to the drum sections and the shaft.

Preferably the drum sections axially at both sides of the circumferential axial space have even or smooth circumferential outer surfaces without a labyrinth structure or a lip seal. The drum sections have smooth surfaces with suitable clearance and therefore they are substantially easy to manufacture and still provides adequate sealing.

According to an embodiment of the disclosure, a circumferential surface of the at least one of the drum sections of the balancing drum and an opposing inner surface of the housing comprise a slide bearing between the balancing drum and the housing.

The slide bearing between at least one of the drum sections and radially opposing inner surface of the housing is configured to bear radial forces by a liquid film of pumped liquid between the surfaces, when in use. Thus, no separate lubricant for the bearing is needed. The balancing drum operates as a radial bearing which provides radial support to the shaft adjacent to the last stage of the pump and also a substantially small gap between the surfaces. This way leakage loss is also decreased.

According to an embodiment of the disclosure all of the cylindrical surfaces of the balancing drum sections and opposing inner surfaces of the housing form a slide bearing between the balancing drum and the housing. This provides an effect of obtaining small gap in all of the section of the balancing drum and radial support to the rotating parts. When there are several, separate opposing counter surface (the slide bearing), possible increased leakage of one slide bearing due to for example damage of the surfaces, does not totally damage the balancing drum.

According to an embodiment of the disclosure the balancing drum comprises at least three drum sections and two circumferential axial spaces, wherein the balancing drum has drum sections at both sides of each one of the axial spaces.

each one of the axial spaces has a cylindrical bottom having a second radius there is a ring element in connection with each one of the axial spaces there is a second annular flow path is provided between the second pressure chamber and the first pressure chamber via each the outer surface of each drum section of the balancing drum and inner surface of the housing.

In this embodiment the multistage balancing drum comprises three stages. It has been discovered that three stages provide considerable decrease in the power consumption of the balancing drum due to the fact, that required radius in a multistage balancing drum is smaller than in a single stage balancing drum which provides equivalent compensation of axial forces.

According to an embodiment of the disclosure the balancing drum comprises three circumferential axial spaces, wherein the balancing drum having drum sections at both sides of each one of the axial spaces, each one of the axial spaces having a cylindrical bottom having a second radius a ring element in connection with each one of the axial spaces a second annular flow path is provided between the second pressure chamber and the first pressure chamber via each the outer surface of each drum section of the balancing drum and inner surface of the housing.

According to an embodiment of the disclosure the axial spaces are identical and that the ring elements are identical.

According to an embodiment of the disclosure axial length of the circumferential axial space is 1.05-2 times the axial length of the ring element.

According to an embodiment of the disclosure in the balancing drum section which is closest to the last stage of the multi-stage centrifugal pump, the drum section and opposing inner surface of the housing form a slide bearing and the slide bearing has a bearing clearance therebetween such that a liquid film is arranged between cylindrical surfaces of the drum sections and a cylindrical inner surface of the housing. The drum sections of the balancing drum and opposing inner surface of the housing may be provided with a separate bearing sleeve on one or both of the surfaces.

This arrangement provides improved radial support to the assembly.

According to an embodiment of the disclosure all of the drum sections of the balancing drum and opposing inner surface of the housing form a slide bearing between the balancing drum and the housing, and the slide bearing has a bearing clearance less than 50 μm arranged between cylindrical surfaces of the drum sections and a cylindrical inner surface of the housing. The drum sections of the balancing drum and opposing inner surface of the housing can include a separate bearing ring on one or both of the surfaces.

According to an embodiment of the disclosure the bearing clearance is less than 0.15 mm.

According to an embodiment of the disclosure the cylindrical counter surfaces of the balancing drum section and opposing housing surfaces comprise steel-silicon carbide counter surfaces.

According to an embodiment of the disclosure the cylindrical counter surfaces of the balancing drum section and opposing housing comprise coated steel-polyether ether ketone counter surfaces.

According to an embodiment of the disclosure the cylindrical counter surfaces of the balancing drum section and opposing housing comprise silicon carbide-silicon carbide counter surfaces.

According to an embodiment of the disclosure radial gap between the bottom of the circumferential axial space and inner surface of the ring element includes a mechanical sealing, and the circumferential surface of at least one of the drum sections of the balancing drum and opposing inner surface of the housing comprise a slide bearing between the balancing drum and the housing.

The exemplary embodiments of the disclosure presented in this patent application are not to be interpreted to pose limitations to the applicability of the appended claims. The verb "to comprise" is used in this patent application as an open limitation that does not exclude the existence of also unrecited features. The features recited in dependent claims are mutually freely combinable unless otherwise explicitly stated. The novel features which are considered as characteristic of the disclosure are set forth in particular in the appended claims.

BRIEF DESCRIPTION OF DRAWINGS

The disclosure will be explained in more detail hereinafter with reference to the drawings.

DETAILED DESCRIPTION

Figure 1:
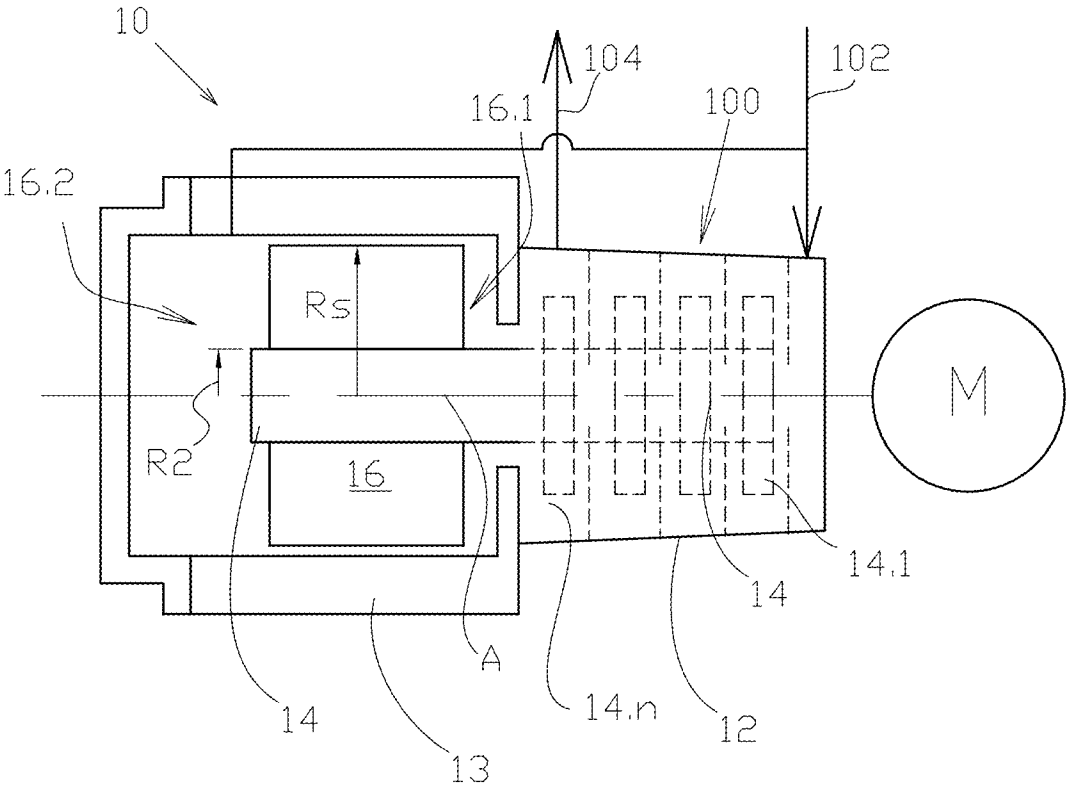
Fig. 1 PRIOR ART
FIG. 1 illustrates a prior art solution for compensating axial forces in a multi-stage centrifugal liquid pump.

FIG. 1 schematically depicts a multiphase centrifugal pump 100 including a balancing drum according to the prior art. The multi-stage pump 100 itself is not explained in a more detailed manner as being known as such for a skilled person in the art. The pump has a liquid inlet 102 and a liquid outlet 104 for the liquid to be pumped. The pump has a shaft 14 and a housing 12. The shaft is rotatable supported to the housing 12 of the pump by suitable bearings (not shown) and it has a center axis A around which the shaft is rotatable. The pump is a liquid pump configured to pump substantially pure liquid, such as a water pump. The bearings comprise at least radial bearings. The pump may also include one or more axial thrust bearings, but the need for axial thrust bearings is minimized, or in some practical cases even eliminated, by the embodiments of the present disclosure.

The multi-stage pump 100 in FIG. 1 has more than one impeller 14.1 . . . **14.*n* which are attached to the common shaft 14. The shaft may be driven by an electric motor M coupled with the shaft directly or via a coupling. The pump 100 includes a single stage balancing drum 16 which is arranged to the shaft 14. The shaft 14 is common for the centrifugal pump 100 and the balancing drum 16. It can be said that the shaft and the balancing drum 16 belong to the rotatable parts of the balancing assembly 10 by their nature when operating the pump 100. The balancing drum 16 is arranged to a housing 13 of the balancing drum assembly 10**.

The balancing drum 16 has a radius Rs and the shaft of the balancing drum has a radius R2. The balancing drum 16 has a first axial end surface 16.1 which is in flow communication with the outlet 104 of the pump and therefore the maximum pressure p2 produced by the pump is subjected to the first axial end surface 16.1. The flow communication may be arranged inside the housing, via an annual gap around the shaft. The balancing drum has also a second axial end surface 16.2. The first axial end surface is on the side of the pump 100 and it is at opposite end to the second axial end surface 16.2. The second axial end surface 16.2 is in flow connection with an inlet 102 of the pump and therefore the inlet pressure p1 of the pump 100 is subjected to the second axial end surface 16.2. The balancing drum 16 is rotationally symmetrical in respect to the axis A.

The mechanism of balancing the axial forces is based on the pressure difference axially over the balancing drum and areas of the axial end surfaces of the balancing drum. The balance of forces for the single stage balancing drum can be written as follows (equation 1):

$$F1=\pi(x^2-1)\cdot R2^2\cdot\Delta p+\mathrm{Fax}, \quad (1)$$

where

F1=axial force subjected to the second axial end surface by the pressure difference Fax=axial force subjected to end face (area of R2) of the shaft $$x=\frac{Rs}{R2}$$

where R2 is radius of the shaft of the balancing drum at both sides thereof and Rs is the radius of the single stage balancing drum, Δp=the pressure difference between the first and the second axial end of the balancing drum 16.

The pressure difference over the balancing drum causes a leakage loss, which is proportional to a clearance gap between the balancing drum and its housing. Also, rotation of the balancing drum causes friction/pumping loss, which increases the total demand of shaft power.

Figure 2:
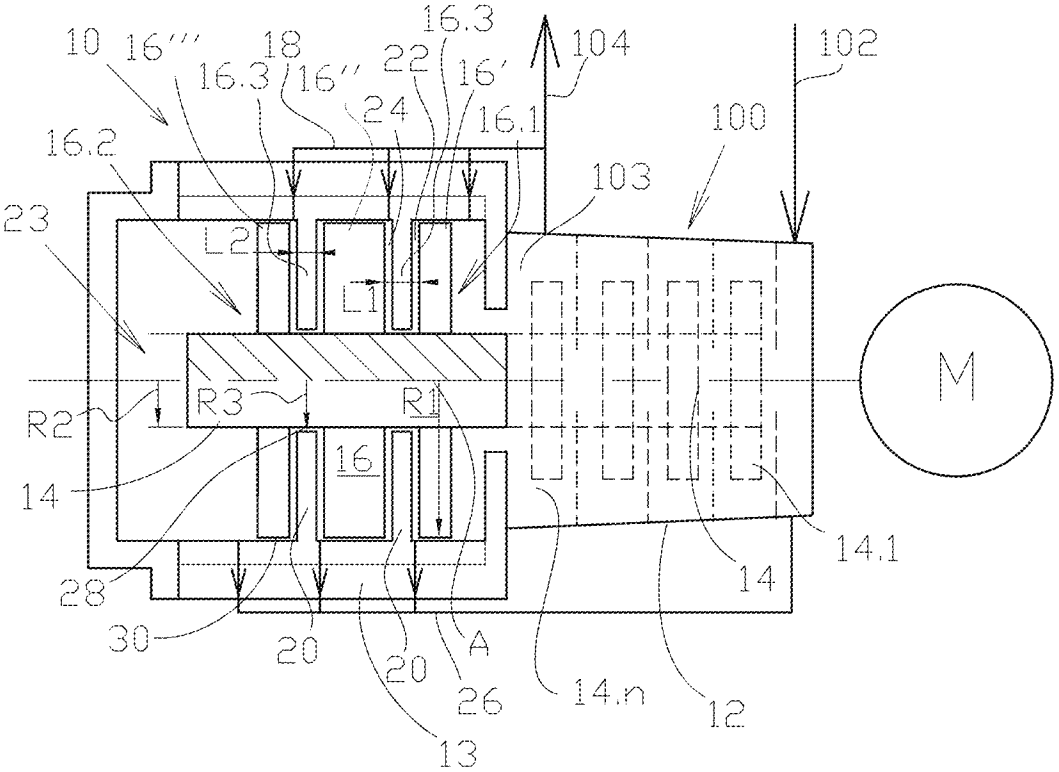
FIG. 2 illustrates an assembly for compensating axial forces in a multi-stage centrifugal liquid pump according to an embodiment of the invention.

FIG. 2 schematically depicts a multiphase centrifugal pump 100 including a multi-stage balancing drum according to the disclosure. The pump 100 itself is not explained in a more detailed manner as being known as such for a skilled person in the art. The pump has a liquid inlet 102 and a liquid outlet 104 for the liquid to be pumped. The pump has a shaft 14 and a housing 12. The shaft is rotatable supported to the housing 12 of the pump by suitable bearings (not shown) and it has a center axis A around which the shaft is rotatable. The pump is a liquid pump configured to pump substantially pure liquid, such as a water pump. The bearings comprise at least radial bearings. The pump may also be provided with one or more axial thrust bearings, but the need for axial thrust bearings is minimized, or in some practical cases even eliminated, by the present invention.

The multi-stage pump 100 in FIG. 2 has more than one impeller 14.1 . . . 14.*n* which are attached to the common shaft 14. The shaft may be driven by an electric motor M coupled with the shaft directly or via a coupling. The pump 100 includes an assembly for compensating axial forces 10 according to an embodiment of the invention. The assembly for compensating axial forces 10 will be referred to as a balancing drum assembly 10 in the following. The balancing drum assembly 10 comprises a balancing drum 16 which is arranged to the shaft 14. The shaft 14 is common for the centrifugal pump 100 and the balancing drum 16. It can be said that the shaft and the balancing drum 16 belong to the rotatable parts of the balancing assembly 10 by their nature when operating the pump 100. The balancing drum 16 is arranged to a housing 13 of the balancing drum assembly 10. Advantageously the centrifugal pump 100 and the balancing drum assembly 10 have a common housing 12, 13 which may be suitably constructed from separate parts. The shaft 14 of the balancing drum 16 has a radius R2 of equal size at both sides of the balancing drum, whereas the balancing drum has a radius R1. The balancing drum 16 has a second axial end surface 16.2 at an end of the shaft 14. The first axial end surface is on the side of the pump 100 and it is at an opposite end to the second axial end surface 16.2. The second axial end surface 16.2 is in flow connection with an inlet 102 of the pump and therefore the inlet pressure p1 of the pump 100 is subjected to the second axial end surface 16.2. The balancing drum 16 is rotationally symmetrical in respect to the axis A.

The balancing drum 16 of the balancing drum assembly 100 comprises at least one circumferential axial cylindrical space 16.3 which extends radially towards the center and which is arranged at an outer surface of the balancing drum. In the embodiment of FIG. 2 there are two circumferential axial spaces 16.3 arranged between the first axial end surface 16.1 and a second axial end surface 16.2 of the balancing drum 16. The circumferential axial space extends from the outer surface of the balancing drum towards the axial center, having a bottom radius R2, which is equal to the radius of the shaft 14. The outer surface of the balancing drum 16 has a first radius R1. This way the drum 16 comprises at least two drum sections 16', 16" which are in series one after the other, and the balancing drum can be referred to as a multi-stage balancing drum, accordingly. The drum sections 16',16" are cylindrical sections arranged axially at both sides of the axial space 16.3. The cylindrical surface is a plain or smooth surface, without any texture or pattern protruding from general level of the cylindrical surface. When the balancing drum 16 has two axial spaces 16.3, as is the case in FIG. 2, it also has three drum sections 16',16",16'". In the Figures, all the drum sections have the first radius R1 which is of equal size in each drum section. The balancing drum 16 terminates axially to a drum section 16',16" at both ends thereof such that the end surfaces have the first radius R1. The at least one axial space 16.3 has a first axial length L1 and a cylindrical bottom having radius R2. The radius of the bottom of the axial space equals to the radius of the shaft 14 at axially both ends of the multistage balancing drum 16. The axial space 16.3 has planar radial side walls forming a rectangular axial cross section. The balancing drum is preferably a multipart drum assembled from several parts.

The balancing drum assembly 100 comprises, in connection with the housing 13, a ring element 20 at axial position of the at least one circumferential axial space 16.3 such that the ring element 20 is extending radially into the axial space to proximity of the bottom of the axial space. The ring element 20 has a cylindrical radial inner surface having a third radius R3, which is greater than the second radius R2. The radial inner surface of the ring element is a plain or smooth surface, without any texture or pattern protruding from general level of the surface. This way an annular clearance gap is formed between the radial cylindrical faces of the ring element and the bottom of the circumferential axial space. The clearance gap provides an axial flow restriction resulting in a pressure difference over the balancing drum, when in use. The ring element 20 has also planar side walls. The ring element 20 has a second axial length L2, which is less than the first axial length L1 such that the ring element fits into the axial space. The ring element divides the circumferential axial space axially into two chambers 22,24. The ring element forms a first pressure chamber 22 between a first axial side wall of the circumferential axial space 16.3 and a first axial side wall of the ring element 20, and a second pressure chamber 24 between a second axil side wall of the circumferential axial space 16.3 and a second axial side wall of the ring element 20. As it becomes clear from the Figure the pressure chambers are annular spaces. There is a first clearance gap 28 between the ring element 20 and the bottom of the circumferential axial space. The clearance gap forms a first annular flow path between the first pressure chamber 22 and the second pressure chamber 24 via the bottom of the circumferential axial space 16.3 and inner surface of the ring element 20. There is a second clearance gap 30 between the drum section 16',16",16'" and the housing. The clearance gap forms a second annular flow path extending from the first pressure chamber 22 and from the second pressure chamber 24 via the outer surface of the drum sections 16', 16'" and the inner surface of the housing 12. The gaps form a flow constriction or a seal between the pressure chambers. The ring element 30 can be a separate or an integral part of the structure of the body of the balancing drum.

In order to deploy the pressure chambers into use, the assembly 100 comprises a flow communication system for delivering liquid working pressure to the chambers from the pump. The assembly comprises a first flow communication path 18 which connects the outlet 104 of the pump to each second pressure chamber 24 between the second side wall of the circumferential axial space 16.3 and the second side wall of the ring element 20. This means in terms of FIG. 2, that the outlet 104 is in connection with the second chamber of both of the circumferential axial space s 16.3. The second pressure chambers 24 are connected in parallel with each other. This way the outlet pressure p2 of the pump effects in each one of the second pressure chambers 24. The outlet pressure p2 effects also on the first axial end surface 16.1 of the multistage balancing drum 16.

The assembly comprises respectively a second flow communication path 26 which connects the inlet 102 of the pump to each first pressure chamber 22 between the first side wall of the circumferential axial space 16.3 and the first side wall of the ring element 20, which means in terms of FIG. 2, that the inlet 102 is in connection with the first pressure chamber 22 of both circumferential axial spaces 16.3. The first pressure chambers 22 are also connected in parallel with each other. This way the inlet pressure p1 of the pump effects in each one of the first pressure chambers. The inlet pressure p1 effects also on the second axial end surface 16.2 of the multistage balancing drum 16. The first pressure chamber 22 is nearer to the pump than the second pressure chamber 24.

The first pressure chamber 22 and the second pressure chamber 24 are in flow connection with each other, firstly comprising a first annular flow path via the first clearance gap 28 between inner surface of the ring element 20 and the bottom of the axial space, and secondly comprising a second annular flow path via the second clearance gap 30 between the outer surface of the drum section 16',16",16'" and inner surface of the housing. The clearance gaps are considerably small and since there are several, or at least two of the second clearance gaps 30 and at least one of the first clearance gaps 28 the leakage loss in minimized.

Figure 3:
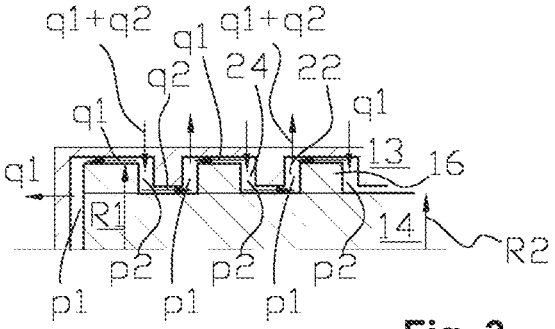
FIG. 3 illustrates a pressure and flow behavior of a three-stage balancing drum according to an embodiment of the invention.

In the following performance of the multistage balancing drum is compared to performance of the prior art solution shown in FIG. 2 by making use of FIG. 3 which describes pressure and flow behavior of a multistage (three-stage) balancing drum according to the invention. FIG. 3 shows a cross section of an upper half of the rotationally symmetrical shaft 14 and rotationally symmetrical the multistage balancing drum 16. FIG. 3 shows liquid flows q1, q2 between the pressure chambers 22, 24 and from and into the first and the second flow communication paths 18, 26. The liquid flow via the second clearance gap 30 between the outer surface of the drum section 16', 16", 16'" and inner surface of the housing is denoted by reference q1, and the liquid flow via the first clearance gap 28 between inner surface of the ring element 20 and the bottom of the circumferential axial space is denoted by reference q2. The liquid flow q1, q2 represents leakage loss of the balancing drum 16.

Now, using a definition:

$$k = \frac{R1}{Rs}$$

Where R1 is the outer radius of the multistage balancing drum according to the invention, and Rs is the outer radius of single stage balancing drum according to the prior art.

And $$x = \frac{Rs}{R2}$$

where R2 is radius of the shaft of the balancing drum and Rs is the radius of the single stage balancing drum, one obtains the balance of forces for the multistage balancing drum as follows (equation 2):

$$F2 = n \cdot \pi (k^2 x^2 - 1) \cdot R2^2 \cdot \Delta p + \mathrm{Fax}, \tag{2}$$

where

F2=total axial force subjected to the second axial end surfaces of the multistage balancing drum by the pressure difference, Fax=axial force subjected to the end of the shaft (area of R2), and n=number of stages in the multistage balancing drum For relative comparison of performance of the multistage balancing drum against the single state balancing drum, we set the force F2 of the equation (2) equal to the force F1 of the equation (1).

This provides a formula for the ratio k as a function of number of stages n in the multistage balancing drum and ratio x of radius of the shaft of the balancing drum and radius of the single stage balancing drum:

$$k = \sqrt[2]{\left(\frac{1}{n} - \frac{1}{n\,x^2} + \frac{1}{x^2}\right)} \tag{3}$$

Power consumed by a balancing drum is proportional to fifth power of its diameter. Thus, relative power consumed by a multistage balancing drum in respect to a single stage balancing drum is $$\frac{P_{multistage}}{P_{single\ stage}} = n \cdot k^5 = n \cdot \left(\sqrt[2]{\left(\frac{1}{n} - \frac{1}{n\ x^2} + \frac{1}{x^2}\right)}\right)^5 \quad (4)$$

where n=number of stages in the multistage balancing drum and k=is defined by the equation (3)

Leakage loss q1 caused by the second clearance gap 30 is proportional to leakage loss of the single stage balancing drum ql as follows $$q1 \sim k^3 \cdot ql \quad (5)$$

and leakage loss q2 caused by the first clearance gap 28 is proportional to the leakage loss of the single stage balancing drum ql as follows $$q2 \sim \frac{1}{x^3} \cdot ql \quad (6)$$

Thus, relative leakage loss of a multistage balancing drum in respect to a single stage balancing drum is $$\frac{q_{multistage}}{q_{single\ stage}} = n \cdot k^3 = \frac{n-1}{x^3} = n \cdot \left(\sqrt[2]{\left(\frac{1}{n} - \frac{1}{n\ x^2} + \frac{1}{x^2}\right)}\right)^3 + \frac{n+1}{x^3} \quad (7)$$

Figure 4:
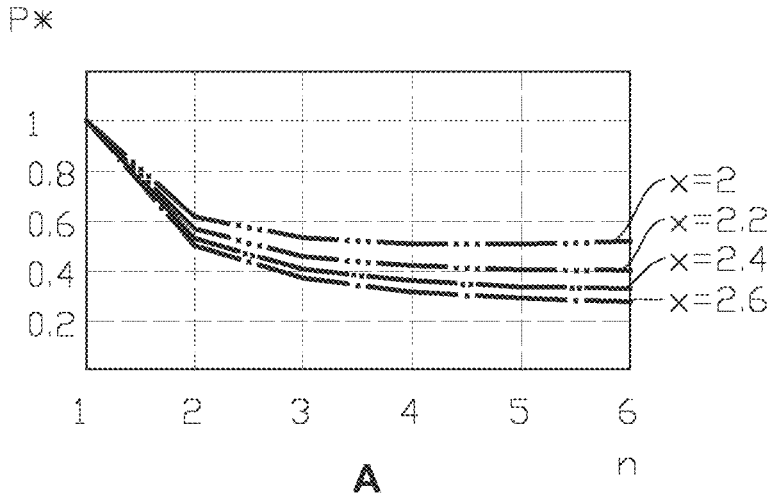
FIG. 4A illustrates a chart showing a relative friction power of the present invention compared to prior art solution.
FIG. 4B illustrates a chart showing a relative leakage in the balancing drum assembly of the present invention compared to prior art solution.
Figure 4:
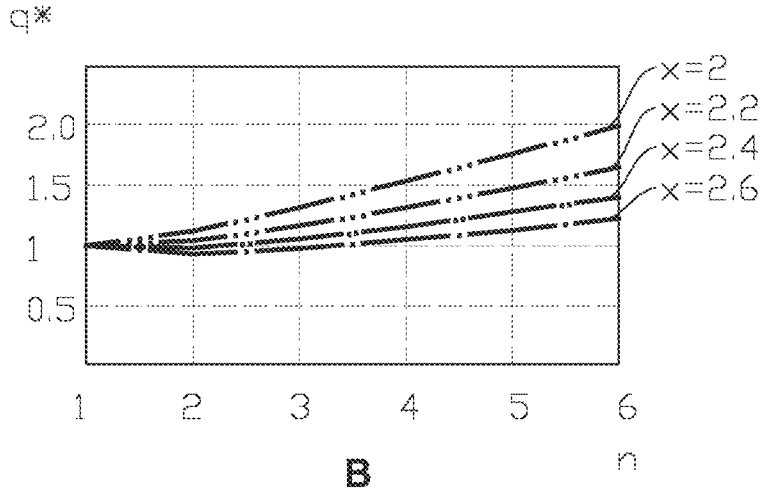

In the following, with a reference to FIG. 4, performance of the multistage balancing drum is compared to performance of the prior art solution shown in FIG. 2. FIG. 4 which describes pressure and flow behavior of a multistage balancing drum. FIG. 4A illustrates the relative power consumption according to the equation (4) and FIG. 3*b* illustrates the relative leakage loss according to the equation (7). As it can be seen in the chart energy efficiency is considerably improved from single stage balancing drum when the number of stages is 2 or 3, while increasing the number of stages to more than 3 does not result in so big improvement than changing from single stage to 2 or 3 stages.

The first radius R1 of the multi-stage balancing can be, according to the invention, considerably small compared to the radius Rs of a single stage balancing drum. As an example, when the ratio x in a prior art balancing drum is 2.2, the relative power consumption with multistage balancing drum is less than 0.6 when there are 2 stages in the balancing drum. Diameter of the multistage balancing drum is in this case is about 20% smaller than diameter of corresponding single stage balancing drum, that is that ratio k is about 0.78. This means in practice that the invention provides smaller radial dimensions, saving space and material.

Figure 5:
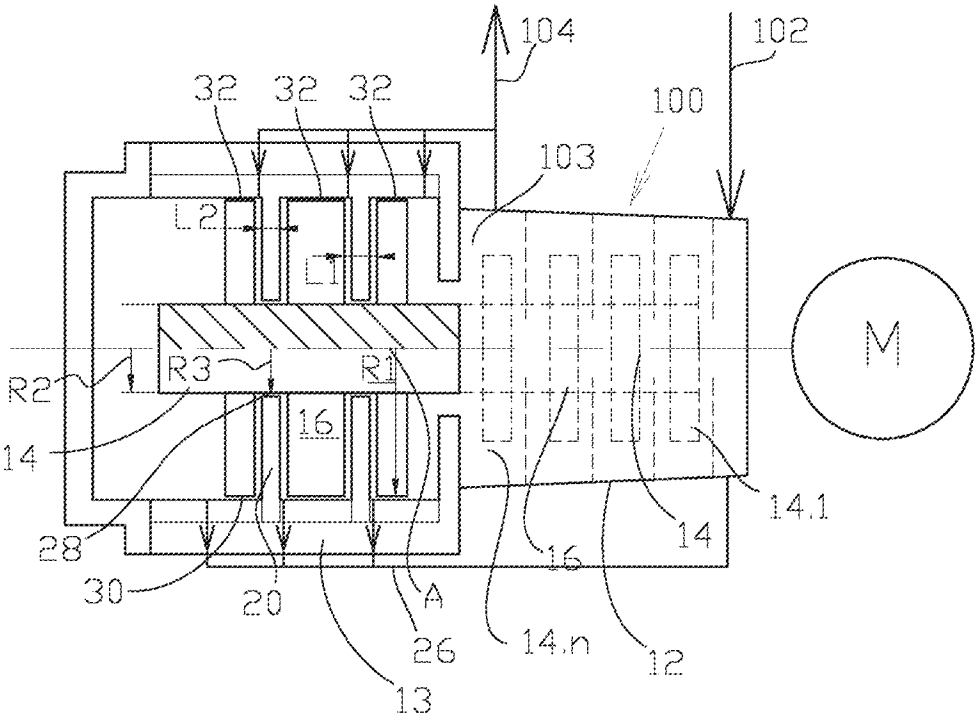
FIG. 5 illustrates an assembly for compensating axial forces in a multi-stage centrifugal liquid pump according to another embodiment of the invention.

FIG. 5 discloses an embodiment which is advanced from that shown FIG. 2. In the embodiment of the assembly shown in FIG. 5 there is shown a feature that the circumferential outer surface of each section of the balancing drum and opposing inner surface of the housing form a slide bearing 32 between the balancing drum and the housing. In other words, in this embodiment second clearance gap 20, which also form the second annular flow path, form a slide bearing, which supports the shaft in radial direction only. The inner surface of the housing faces the whole circumferential outer surface area. Even if FIG. 5 shows that each one of the gaps between the drum section and its opposing surface in the housing has a sliding bearing, the most advantageous solution, in some practical cases, only the section of the balancing drum and opposing inner surface of the housing axially nearest to the pump form a slide bearing. The slide bearing comprises preferably one of the counter surfaces of steel-silicon; coated steel-polyether ether ketone of silicon carbide-silicon carbide.

The slide bearings have a small radial gap. Due to the substantially small radial gap, the slide bearings bring about a combination of radial support of the assembly and reduction of leak losses via the small bearing's radial gap.

In other respects, the assembly shown in FIG. 5, as well as its operation is similar to that shown in FIG. 2.

While the invention has been described herein by way of examples in connection with what are, at present, considered to be the embodiments, it is to be understood that the invention is not limited to the disclosed embodiments, but is intended to cover various combinations or modifications of its features, and several other applications included within the scope of the invention, as defined in the appended claims. The details mentioned in connection with any embodiment above may be used in connection with another embodiment when such combination is technically feasible.

The invention claimed is:

1. A multi-stage centrifugal liquid pump comprising:

a housing;

impellers of a pump section; and an assembly configured to compensate axial forces in the multi-stage centrifugal liquid pump, the assembly comprising a shaft arranged rotatably to the housing, the impellers coupled to the shaft, a balancing drum arranged on the shaft inside the housing, the balancing drum having a first axial end surface and a second axial end surface, the first axial end surface in flow communication with a stage of the pump section adjacent to the balancing drum, the balancing drum being a multistage balancing drum, comprising at least two drum sections, and a circumferential axial space arranged between the at least two drum sections, the drum sections having a first radius, each circumferential axial space having a first axial length and a bottom, the bottom having a second radius, which is smaller than the first radius, a ring element at an axial position of each circumferential axial space, extending radially into each circumferential axial space to a proximity of the bottom of each circumferential axial space, the ring element having a radial inner surface having a third radius greater than the second radius, the ring element having a second axial length, which is less than the first axial length, a first pressure chamber between a first side wall delimiting the circumferential axial space and a first side wall of the ring element, a second pressure chamber between a second side wall delimiting the circumferential axial space and a second side wall of the ring element, the first pressure chamber being nearer to the pump section than the second pressure chamber, a first flow communication path extending from the stage of the pump section nearest to the balancing drum to the second pressure chamber, a second flow communication path extending from the stage of the pump section farthest from the balancing drum to the first pressure chamber, a first annular flow path between the first pressure chamber and the second pressure chamber via the bottom of the circumferential axial space and the inner surface of the ring element, and a second annular flow path extending out from the first pressure chamber and from the second pressure chamber via outer surfaces of the drum sections and an inner surface of the housing.

2. The multi-stage centrifugal liquid pump according to claim 1, wherein at least one of the drum sections of the balancing drum and an opposing part of the inner surface of the housing comprise a slide bearing between the balancing drum and the housing.

3. The multi-stage centrifugal liquid pump according to claim 2, wherein each slide bearing is configured to bear radial forces by a liquid film of pumped liquid between the opter surfaces of the drum sections and the inner surface of the housing when in use.

4. The multi-stage centrifugal liquid pump according to claim 3, wherein the outer surfaces of the drum sections and the inner surface of the housing comprise steel-silicon carbide counter surfaces.

5. The multi-stage centrifugal liquid pump according to claim 3, wherein the outer surfaces of the drum sections and the inner surface of the housing comprise coated steel-polyether ether ketone counter surfaces.

6. The multi-stage centrifugal liquid pump according to claim 3, wherein the outer surfaces of the drum sections and the inner surface of the housing comprise silicon carbide-silicon carbide counter surfaces.

7. The multi-stage centrifugal liquid pump according to claim 3, wherein each slide bearing has a bearing clearance arranged between the outer surfaces of the drum sections and the inner surface of the housing.

8. The multi-stage centrifugal liquid pump according to claim 2, wherein each slide bearing has a bearing clearance arranged between the outer surfaces of the drum sections and the inner surface of the housing.

9. The multi-stage centrifugal liquid pump according to claim 8, wherein the bearing clearance is less than 0.15 mm.

10. The multi-stage centrifugal liquid pump according to claim 2, wherein the outer surfaces of the drum sections and the inner surface of the housing comprise steel-silicon carbide counter surfaces.

11. The multi-stage centrifugal liquid pump according to claim 2, wherein the outer surfaces of the drum sections and the inner surface of the housing comprise coated steel-polyether ether ketone counter surfaces.

12. The multi-stage centrifugal liquid pump according to claim 2, wherein the outer surfaces of the drum sections and the inner surface of the housing comprise silicon carbide-silicon carbide counter surfaces.

13. The multi-stage centrifugal liquid pump according to claim 2, wherein the at least two drum sections comprises at least three drum sections.

14. The multi-stage centrifugal liquid pump according to claim 1, wherein all of the drum sections of the balancing drum and opposing parts of the inner surface of the housing comprise a slide bearing between the balancing drum and the housing.

15. The multi-stage centrifugal liquid pump according to claim 1, wherein the at least two drum sections comprises at least three drum sections.

16. The multi-stage centrifugal liquid pump according to claim 15, wherein the circumferential axial spaces includes three axial spaces and the at least two drum sections include four drum sections.

17. The multi-stage centrifugal liquid pump according to claim 15, wherein the circumferential axial spaces are identical and the ring elements are identical.

18. The multi-stage centrifugal liquid pump according to claim 1, wherein an axial length of each circumferential axial space is 1.05-2 times an axial length of each ring element.

19. The multi-stage centrifugal liquid pump according to claim 1, wherein a radial gap between the bottom of each circumferential axial space and the inner surface of each ring element includes a mechanical sealing.

* * * * *